US011682844B2

(12) United States Patent
Tang et al.

(10) Patent No.: US 11,682,844 B2
(45) Date of Patent: Jun. 20, 2023

(54) HEATSINK ANTENNA ARRAY STRUCTURE

(71) Applicant: SHANGHAI JIAO TONG UNIVERSITY, Shanghai (CN)

(72) Inventors: Min Tang, Shanghai (CN); Jiawei Qian, Shanghai (CN); Yueping Zhang, Shanghai (CN); Junfa Mao, Shanghai (CN)

(73) Assignee: SHANGHAI JIAO TONG UNIVERSITY, Shanghai (CN)

( * ) Notice: Subject to any disclaimer, the term of this patent is extended or adjusted under 35 U.S.C. 154(b) by 0 days.

(21) Appl. No.: 17/761,143

(22) PCT Filed: Oct. 21, 2020

(86) PCT No.: PCT/CN2020/119212

§ 371 (c)(1),
(2) Date: Mar. 16, 2022

(87) PCT Pub. No.: WO2021/078009

PCT Pub. Date: Apr. 29, 2021

(65) Prior Publication Data

US 2022/0352647 A1 Nov. 3, 2022

(30) Foreign Application Priority Data

Oct. 22, 2019 (CN) ..... 201911008244.3

(51) Int. Cl.
*H01Q 21/06* (2006.01)
*H01Q 1/02* (2006.01)

(52) U.S. Cl.
CPC ..... *H01Q 21/064* (2013.01); *H01Q 1/02* (2013.01)

(58) Field of Classification Search
CPC ... H01Q 21/064; H01Q 13/18; H05K 7/20409
See application file for complete search history.

(56) References Cited

U.S. PATENT DOCUMENTS

2007/0139287 A1* 6/2007 Inomata ..... G01S 7/032 343/786
2011/0279190 A1* 11/2011 Liu ..... H01P 5/085 333/32

(Continued)

FOREIGN PATENT DOCUMENTS

CN 102035061 A 4/2011
CN 104105380 A 10/2014

(Continued)

OTHER PUBLICATIONS

Duffy et al. ("Stepped notch antenna array used as a low thermal resistance heatsink", 2013 IEEE Antennas and Propagation Society International Symposium (APSURSI); Jan. 27, 2014).*

(Continued)

*Primary Examiner* — Ricardo I Magallanes
(74) *Attorney, Agent, or Firm* — Hamre, Schumann, Mueller & Larson, P.C.

(57) ABSTRACT

The invention relates to a heatsink antenna array structure, which includes a fin-shaped metal heatsink, a metal bottom base of heatsink, and a substrate. The upper surface of substrate is connected with the metal bottom base of heatsink, the lower surface is connected with a chip. The chip works as heat source. There is a rectangular through-cavity array in the bottom base as radiation aperture. The substrate contains multiple metal layers and dielectric layers. The top metal layer has rectangular apertures corresponding to the rectangular through-cavity array in the bottom base. The dielectric layers contain metallic vias to construct a substrate integrated waveguide structure. The metallic vias effectively reduce the thermal resistance between the fin-shaped metal heatsink and the chip, and form the substrate integrated waveguide structure as the feeding network of heatsink antenna array. Compared with the prior arts, the present (Continued)

invention realizes a conformal structure of antenna and heatsink, which improves the integration level of system.

9 Claims, 6 Drawing Sheets

(56) References Cited

U.S. PATENT DOCUMENTS

| | | | | |
|---|---|---|---|---|
| 2014/0016272 | A1 | 1/2014 | Chiang et al. | |
| 2017/0271776 | A1* | 9/2017 | Biancotto | H01Q 21/064 |
| 2018/0358710 | A1 | 12/2018 | Toyao et al. | |
| 2020/0287291 | A1* | 9/2020 | Yang | H01Q 1/523 |

FOREIGN PATENT DOCUMENTS

| | | | | |
|---|---|---|---|---|
| CN | 109742538 | A | 5/2019 | |
| CN | 110676555 | A | 1/2020 | |
| WO | WO-2009005912 | A2 * | 1/2009 | H01Q 13/106 |

OTHER PUBLICATIONS

Arlon CLTE microwave materials specification sheet, 2000. Downloaded on Sep. 9, 2022.*

ABLESTIK CF 3350 Techinical Data Sheet, Mar. 2021.*

Dogan et al. "Variation of Radiated Emission from Heatsinks on PCB according to Fin Types"; 2019 3rd International Symposium on Multidisciplinary Studies and Innovative Technologies (ISMSIT). Dec. 16, 2019 (Year: 2019).*

Zhou et al. "Substrate Integrated Waveguides Slot Antenna Array with Heatsink Enclosed"; 2020 9th Asia-Pacific Conference on Antennas and Propagation (APCAP). Nov. 9, 2020 (Year: 2020).*

Qian et al. "Heatsink Antenna Array for Millimeter-Wave Applications"; IEEE Transactions on Antennas and Propagation (vol. 68, Issue: 11, Nov. 2020) (Year: 2020).*

Qian et al. "A Novel Heatsink Antenna Array"; 2020 9th Asia-Pacific Conference on Antennas and Propagation (APCAP). Nov. 9, 2020 (Year: 2020).*

International Search Report (with English translation) and Written Opinion issued in PCT/CN2020/119212, dated Dec. 30, 2020, 11 pages provided.

Jamshidi-Zarmehri et al., Design and Development of High-Gain SIW H-Plane Hom Antenna Loaded With Waveguide, Dipole Array, and Reflector Nails Using Thin Substrate, Published in IEEE Transactions on Antennas and Propagation, vol. 67, Issue: 4, Apr. 2019.

Song et al., "A design for high-efficiency circularly polarized cavity-backed antenna array", Chinese Journal of Radio Science, vol. 29 No. 1, Feb. 2014, with English Abstract.

* cited by examiner (a)

(b)

HEATSINK ANTENNA ARRAY STRUCTURE

The present application Claims for the priority benefit of the Chinese Patent Application CN 2019110082443 with the Application Date of Oct. 22, 2019. The present application makes reference to the full text of the Chinese Patent Application above.

BACKGROUND OF THE INVENTION

Technical Field

The present invention relates to the field of antenna technology. Specifically, it is a heatsink antenna array structure.

Description of Related Art

With the development of wireless communication technology, the application of highly integrated and miniaturized wireless communication systems is becoming more and more popular. In the system design, in order to make full use of space resources and reduce the energy loss caused by transmission, multiple active and passive components including chips, front-end circuits, and antennas are required to be integrated within a limited package. Although the total input power of the system has been reduced, due to the reduction of the overall size, the thermal power per unit volume will increase, which may cause the degradation of device performance, and results in the failure of system. Therefore, in practical designs, the heat dissipation performance of the system needs to be considered seriously. In order to dissipate the excess heat in the system, an additional heat dissipation structure is usually introduced.

Considering the thermal conductivity, the heat dissipation structure is usually made of metal, and a fin-shaped metal heatsink is a commonly used heat dissipation structure. However, in practical applications, since the metal heatsink is often close to the circuit, it is prone to induce parasitic electromagnetic coupling with various devices, which may cause electromagnetic compatibility problems and induce energy loss or additional noise. Moreover, for integrated system that includes an antenna, the parasitic radiation of the metal heatsink may also cause distortion and deterioration of the overall radiation pattern, which greatly affects the operation of the system. Therefore, the electromagnetic and thermal co-design is particularly important.

In order to realize the electromagnetic and thermal co-design, the existing methods mainly adopt the combination of heatsinks and microstrip patch antennas, for example, adding a fin-shaped metal heatsink on the top of a microstrip patch antenna. This kind of methods can improve the radiation efficiency of the microstrip patch antenna to a certain extent, but since the size of the heatsink base needs to be consistent with the patch size. When the operating frequency increases, the patch size decreases due to the reduction of wavelength. Thus, the design of the heatsink is restricted significantly, and the heat cannot be dissipated effectively. The above-mentioned problems are particularly serious for millimeter wave antenna designs.

BRIEF SUMMARY OF THE INVENTION

To overcome the shortcomings of the prior arts, the present invention introduces a rectangular through-cavity as radiation aperture into the traditional metal bottom base of fin-shaped heatsink, and designs the heatsink structure as an antenna array. This conformal structure improves the integration level of system and is suitable for the co-design of antenna and heat dissipation structure for high-power millimeter-wave transceiver components.

The purpose of the present invention can be achieved by the following technical solutions:

A heatsink antenna array structure, includes the fin-shaped metal heatsink (7), the metal bottom base of heatsink (1), and the substrate. The upper surface of substrate is connected with the metal bottom base of heatsink (1), the lower surface is connected with a chip (14). The chip (14) works as heat source. The metal bottom base of heatsink (1) has the rectangular through-cavity array (8) as radiation aperture. The substrate contains multiple metal layers and dielectric layers. The top metal layer has the rectangular apertures (9) corresponding to the rectangular through-cavity array (8) in the metal bottom base. The dielectric layers contain metallic vias to form the substrate integrated waveguide structure.

The metallic vias in dielectric layers effectively reduce the thermal resistance between the fin-shaped metal heatsink (7) and the chip, and form the substrate integrated waveguide structure as the feeding network of heatsink antenna array.

The rectangular through-cavity array (8) satisfies the TE10 mode of rectangular waveguide. Each rectangular through-cavity array and two adjacent metal fins form the step-profiled horn antenna with quasi electromagnetic operating mode.

The substrate contains three metal layers.

Among them, the top metal layer (2), the top dielectric layer (3), the middle metal layer (4), and the top metallic vias array (10) in the top dielectric layer (3) form the top substrate integrated waveguide structure.

The middle metal layer (4), the bottom dielectric layer (5), the bottom metal layer (6), and the bottom metallic vias array (12) in the bottom dielectric layer (5) form the bottom substrate integrated waveguide structure.

The bottom dielectric layer (5) has the input port of the feeding network (13).

The middle metal layer (4) has the middle metallic vias array (11) with anti-pad structure for transition between the top and the bottom substrate integrated waveguides.

The substrate uses the low temperature co-fired ceramic technique.

The fin height should be larger than half operating wavelength, the fin width is equal to the length of rectangular through-cavity in the metal bottom base of heatsink (1), the spacing between fins should not be larger than one operating wavelength.

The bottom substrate integrated waveguide forms a T-type power divider.

The invention have the following positive effects:

(1) By adopting the electromagnetic and thermal co-design, the antenna array is directly integrated on the fin-shaped heatsink, which greatly saves the system space and solves the electromagnetic compatibility problems caused by the metal heatsink structure.

(2) By introducing the rectangular through-cavity in the bottom base of heatsink, a step-profile horn antenna is realized, which is easy to realize the array structure. The overall size of the heatsink structure is no longer limited to the working wavelength, which is suitable for millimeter-wave applications.

(3) In the low-temperature co-fired ceramic substrate, the substrate integrated waveguide structure is used as the feeding network of heatsink antenna array. It contains many metallic vias, which can serve as the thermal vias to transfer heat from heat source to heatsink without extra heat conduction structure. Therefore, the complexity and cost of design are reduced.

Figure 1:
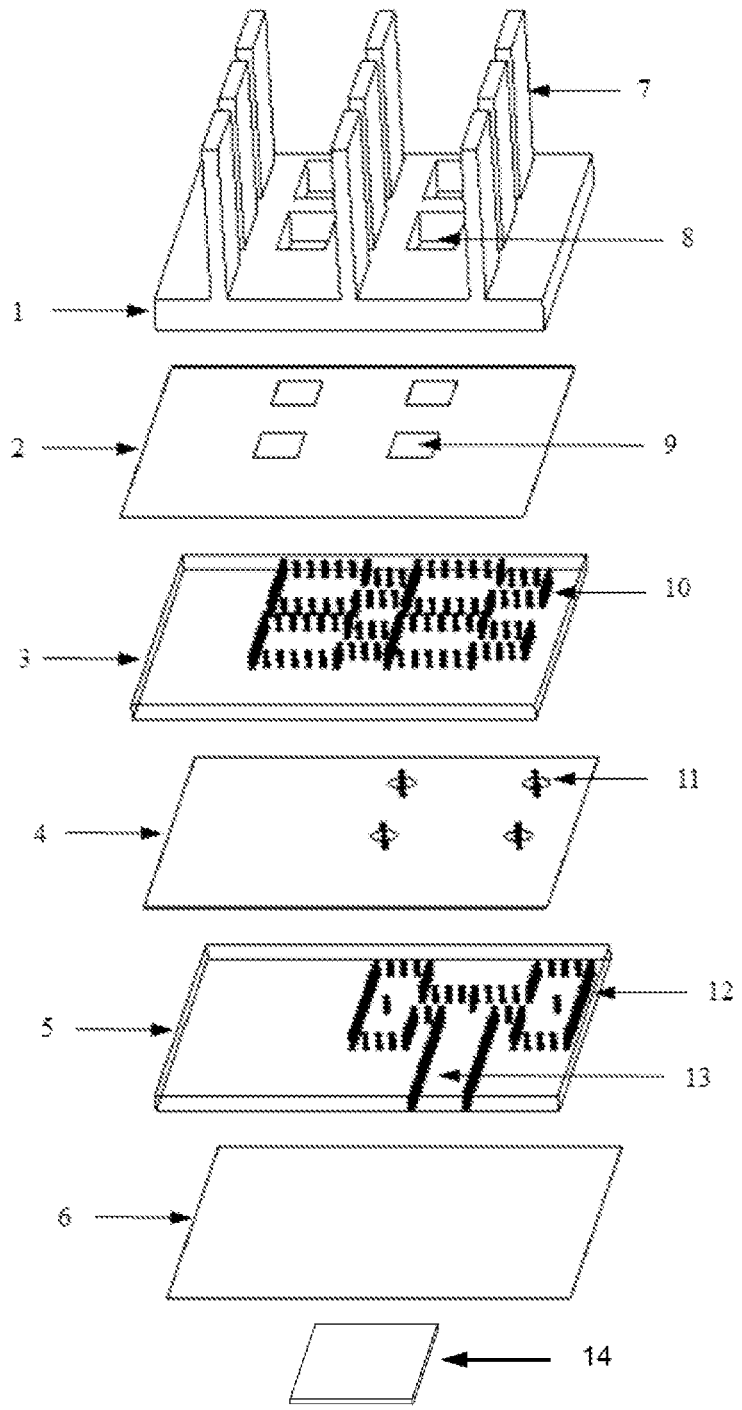
FIG. 1: the overall structure of the 2×2 heatsink antenna array.

Note: 1. Metal bottom base of heatsink. 2. Top metal layer. 3. Top dielectric layer. 4. Middle metal layer. 5. Bottom dielectric layer. 6. Bottom metal layer. 7. Fin-shaped metal heatsink. 8. Rectangular through-cavity array. 9. Rectangular apertures. 10. Top metallic vias array. 11. Middle metallic vias array. 12. Bottom metallic vias array. 13. Input port of the feeding network. 40. Tuning via.

DETAILED DESCRIPTION OF THE INVENTION

The present invention will be described in detail below with reference to the drawings and specific embodiments. This embodiment is implemented on the premise of the technical solution of the present invention, and gives a detailed implementation and specific operation process, but the protection scope of the present invention is not limited to the following embodiments.

A heatsink antenna array structure, includes the fin-shaped metal heatsink 7, the metal bottom base of heatsink 1, and the substrate. The substrate uses the low temperature co-fired ceramic technique. The upper surface of substrate is connected with the metal bottom base of heatsink 1, the lower surface is connected with a chip (14). The chip (14) works as heat source. The metal bottom base of heatsink 1 has the rectangular through-cavity array 8 as radiation aperture. The substrate contains multiple metal layers and dielectric layers. The top metal layer has the rectangular apertures 9 corresponding to the rectangular through-cavity array 8 in the metal bottom base. The dielectric layers contain metallic vias to form the substrate integrated waveguide structure.

The metallic vias in dielectric layers effectively reduce the thermal resistance between the fin-shaped metal heatsink 7 and the chip, and form the substrate integrated waveguide structure as the feeding network of heatsink antenna array.

The rectangular through-cavity array 8 satisfies the TE10 mode of rectangular waveguide. Each rectangular through-cavity array and two adjacent metal fins form the step-profiled horn antenna with quasi electromagnetic operating mode. Specifically, for the rectangular through-cavity in the metal bottom base of heatsink 1, its length should be larger than half operating wavelength, and its width should not be larger than half operating wavelength. For fin-shaped metal heatsink, the fin height should be higher than half operating wavelength, the fin width is equal to the length of rectangular through-cavity, the spacing between fins should not be larger than one operating wavelength.

In this embodiment, the substrate contains three metal layers.

Among them, the top metal layer 2, the top dielectric layer 3, the middle metal layer 4, and the top metallic vias array 10 form the top substrate integrated waveguide structure. By the stepped transition structure, the substrate integrated waveguide is used to feed the heatsink antenna array.

The middle metal layer 4, the bottom dielectric layer 5, the bottom metal layer 6, and the bottom metallic vias array 12 form the bottom substrate integrated waveguide structure.

The bottom dielectric layer 5 has the input port of the feeding network 13.

The middle metal layer 4 has the middle metallic vias array 11 with anti-pad structure for transition between the top and the bottom substrate integrated waveguides.

The transition structure between the top and the bottom substrate integrated waveguides, according to the actual needs, can be realized by other methods such as slot coupling.

The bottom substrate integrated waveguide forms a T-type power divider. According to the actual needs, the Y-type power divider is also available.

The structure of the fin-shaped metal heatsink 7 can be realized using the mold casting and 3-D printing processes, according to the actual needs. Regarding the material of the heatsink, metal materials such as aluminum can be used.

The chip should be mounted on the bottom of the low temperature co-fired ceramic substrate as heat source. The metallic vias in the low temperature co-fired ceramic substrate can work as the thermal vias and transfer heat from heat source to heatsink.

Taking the 2×2 heatsink antenna array structure shown in FIG. 1 as an example, the heatsink antenna array structure provided by this application includes: the metal fin-shaped heatsink 7, the metal bottom base of heatsink 1, the rectangular through-cavity array 8, the top metal layer 2, the rectangular aperture 9, the top dielectric layer 3, the top metallic vias array 10, the middle metal layer 4, the middle metallic vias array with anti-pad structure 11, the bottom dielectric layer 5, the bottom metallic vias array 12, the input port of the feeding network 13, and the bottom metal layer 6.

Figure 2:
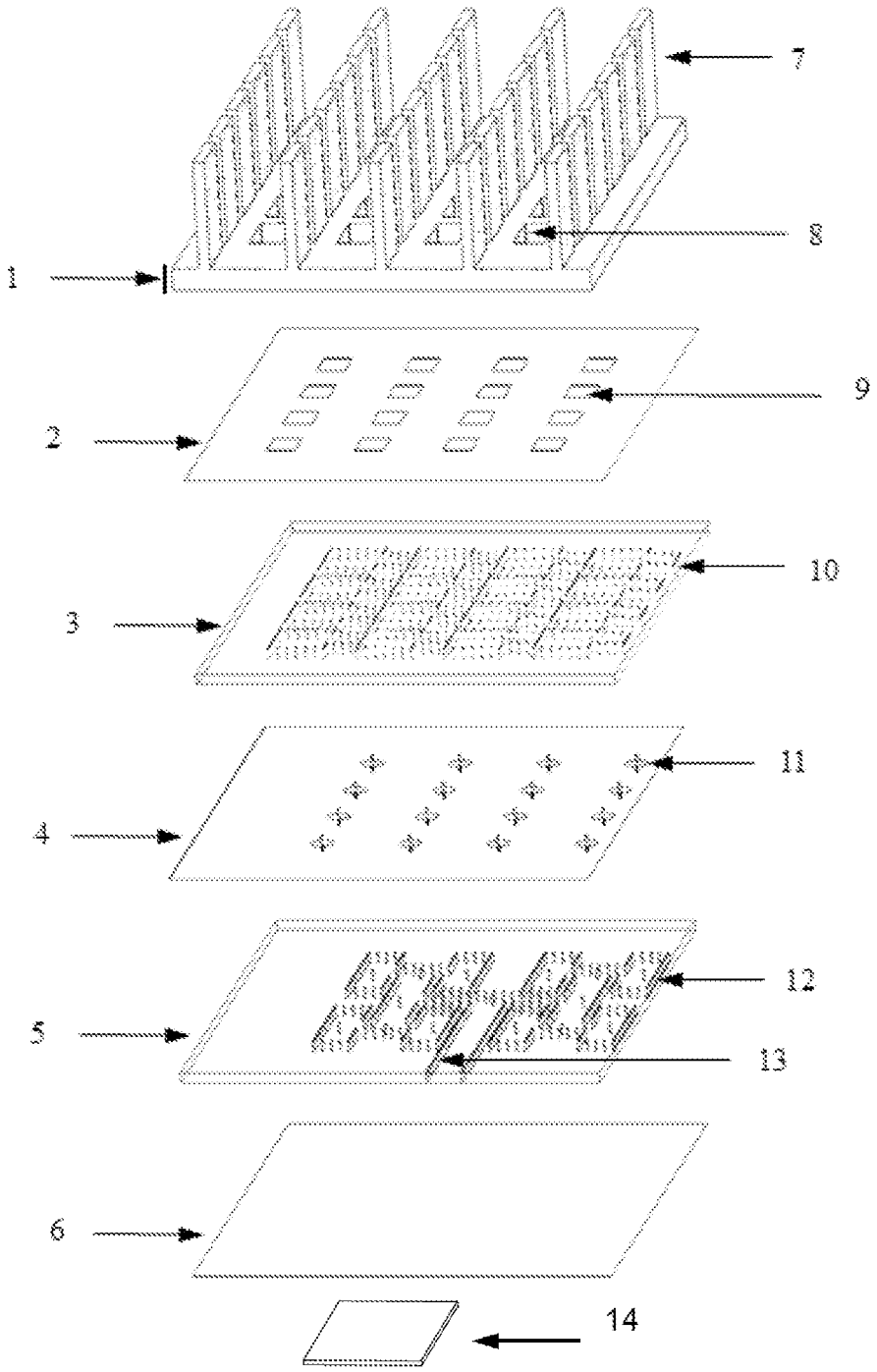
FIG. 2: the overall structure of the 4×4 heatsink antenna array.

In actual implementation, a 60 GHz 4×4 heatsink antenna array is provided as shown in FIG. 2. The metal fin-shaped heatsink 7 is realized by the 3-D printing technique, the top dielectric layer 3 and the bottom dielectric layer 5 are realized by the low temperature co-fired ceramic technique. The dielectric constant and the loss tangent of the low temperature co-fired ceramic are 5.9 and 0.002, respectively. The size of the low temperature co-fired ceramic substrate is 23 mm×19 mm×0.96 mm. The thickness of metal bottom base is 1 mm. Note that the size of substrate and heatsink should be adjusted with the variation of operating frequency.

As shown in FIG. 2, the metal bottom base of heatsink 1 has a 4×4 rectangular through-cavity array. The size of through-cavity is 3 mm×1.5 mm×1 mm, and its width should satisfy the TE10 mode of rectangular waveguide. The size of fin is 5 mm×3 mm×0.5 mm, and the spacing between fins is 4 mm.

As shown in FIG. 2, the top substrate integrated waveguide is formed by the top metal layer 2, the top dielectric layer 3, the top metallic vias array 10, and the middle metal layer 4. The width of waveguide is 1.6 mm. The top metal layer 2 has 4×4 rectangular aperture 9 as the feeding transition structure for heatsink antenna array. The dimension of the rectangular aperture 9 is 8 mm×1.3 mm.

Figure 3:
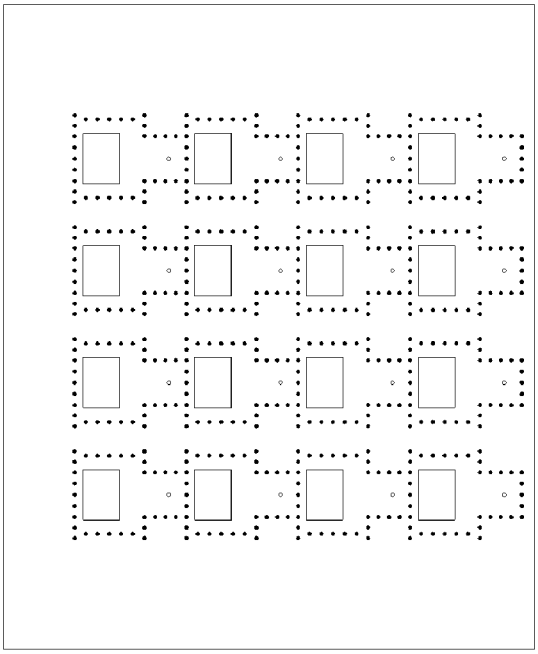
FIG. 3: the overall structure of the top substrate integrated waveguide.

FIG. 3 shows the planar structure of the top substrate integrated waveguide. The width of waveguide is varied from 1.6 mm to 3 mm to achieve a wideband feeding transition structure for the heatsink antenna array.

As shown in FIG. 2, the transition between the top and the bottom substrate integrated waveguides is realized by the metallic vias array with anti-pads. The diameter of anti-pads and middle metallic vias array 11 are 0.6 mm and 0.1 mm, respectively. According to the actual needs, the transition can be realized by other methods such as slot coupling.

As shown in FIG. 2, the bottom substrate integrated waveguide is formed by the middle metal layer 4, the bottom dielectric layer 5, the middle metallic vias array 12, and bottom metal layer 6 on chip (14). The width of waveguide is 1.6 mm.

Figure 4:
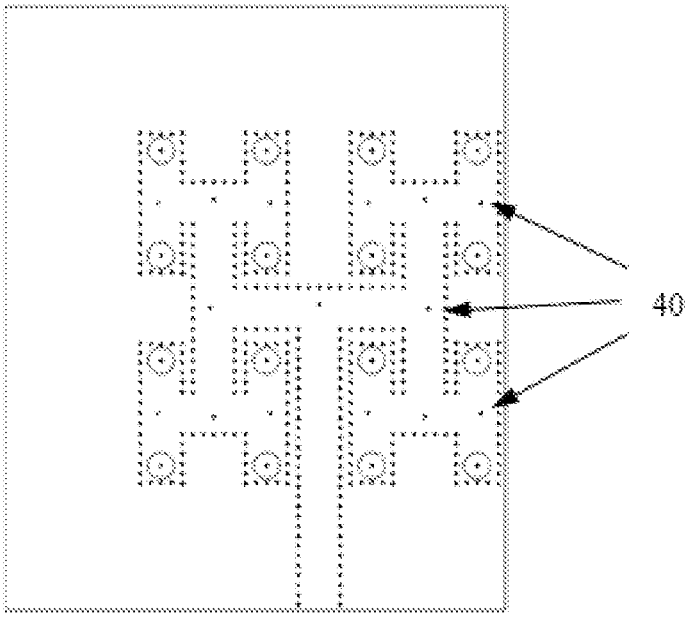
FIG. 4: the overall structure of the bottom substrate integrated waveguide.

FIG. 4 shows the planar structure of the bottom substrate integrated waveguide. A T-type power divider is adopted, and tuning vias 40 are applied in each T-type corner to reduce the return loss. According to the actual needs, the Y-type power divider is also available.

Figure 5:
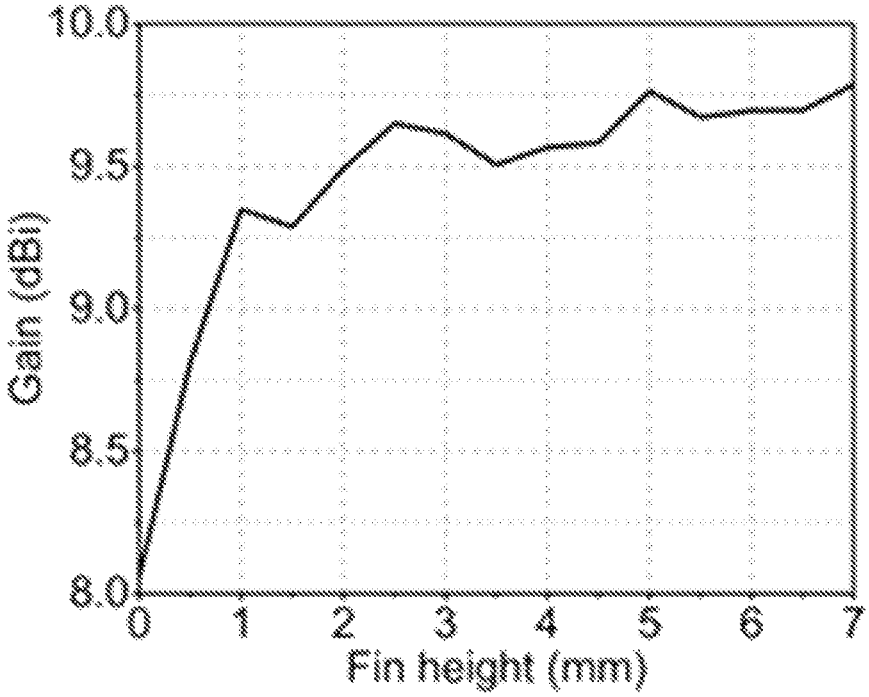
FIG. 5: the gain curve of the 4×4 heatsink antenna array versus the fin height.

FIG. 5 shows the gain of the 4×4 heatsink antenna array versus the fin height. It can be observed that the gain increases with the fin height when the fin height is shorter than one operating wavelength.

Figure 6:
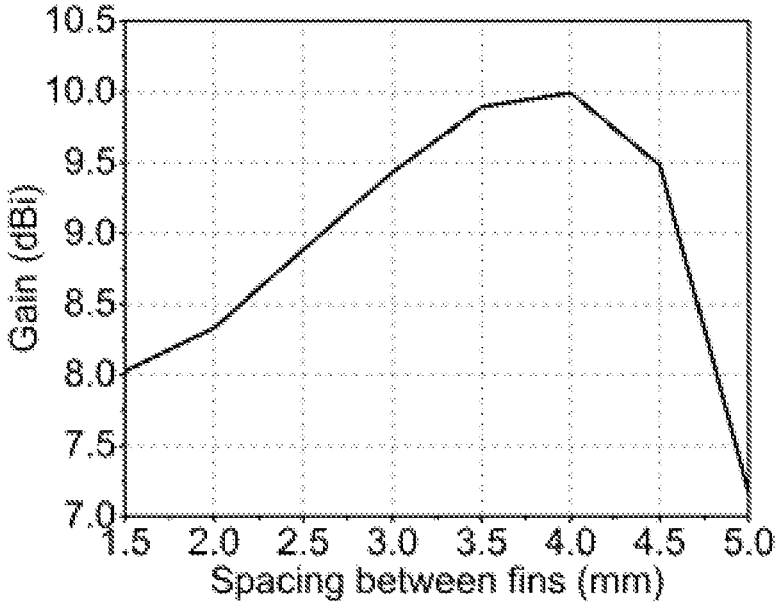
FIG. 6: the gain curve of the 4×4 heatsink antenna array versus the spacing between fins.

FIG. 6 shows the gain of the 4×4 heatsink antenna array versus the spacing between fins. It can be observed that the gain increases with the spacing between fins when the spacing is shorter than one operating wavelength.

Figure 7:
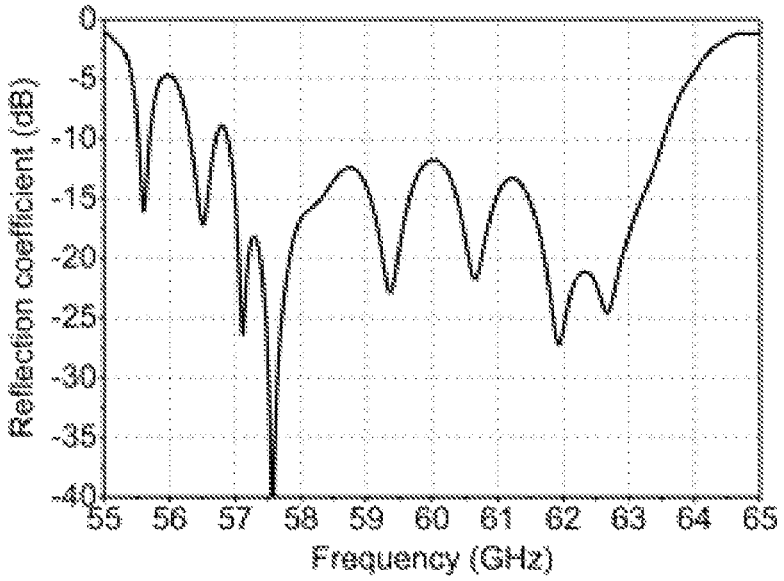
FIG. 7: the reflection coefficient of the 4×4 heatsink antenna array.

FIG. 7 shows the reflection coefficient of the 4×4 heatsink antenna array. The 10-dB impedance bandwidth is 6.6 GHz (56.9 GHz 63.5 GHz) and the fractional bandwidth is 11%.

Figure 8:
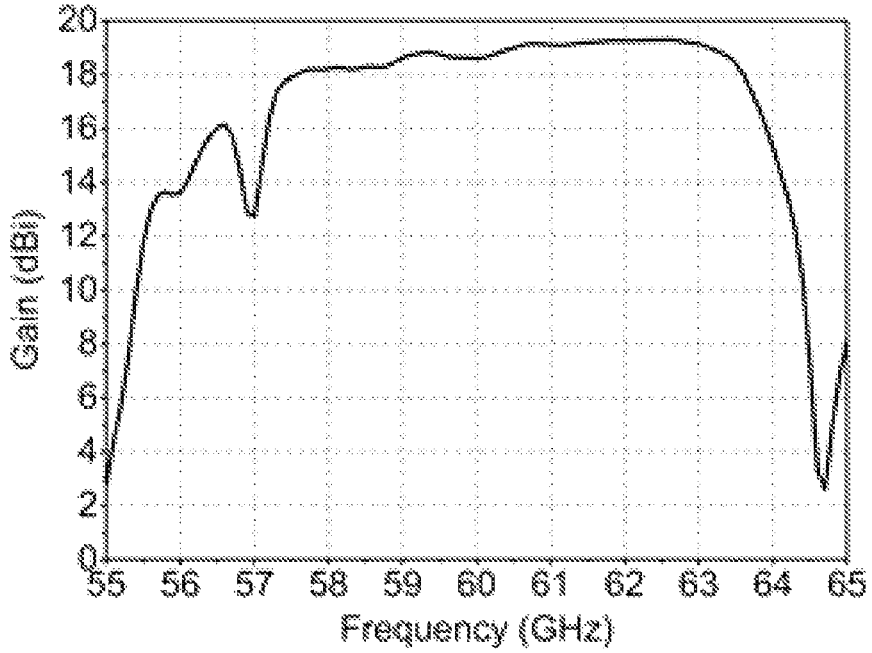
FIG. 8: the gain of the 4×4 heatsink antenna array.

FIG. 8 shows the gain of the 4×4 heatsink antenna array. The gain at the operating frequency 60 GHz is 18.6 dBi, and the peak gain is 19.3 dBi at 62.6 GHz. The 3-dB gain bandwidth is 7.6 GHz (57.2 GHz-63.8 GHz).

Figure 9:
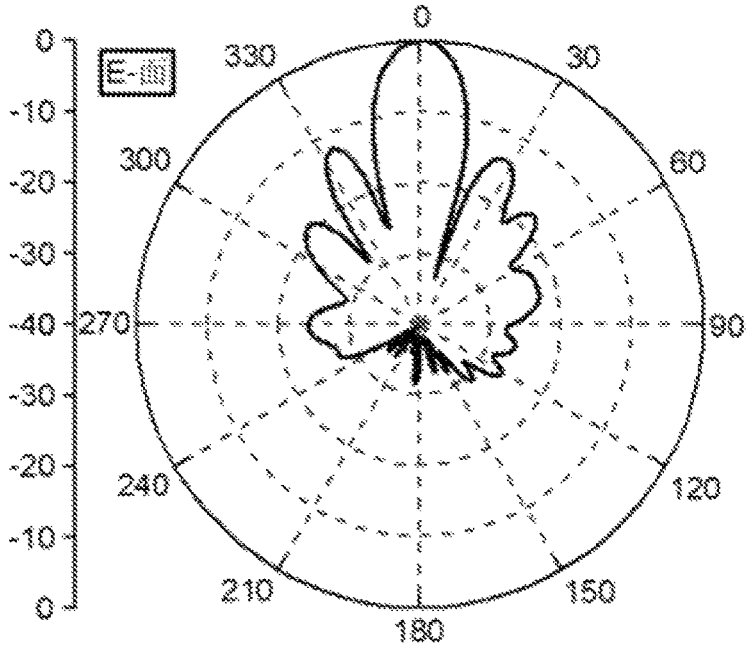
FIG. 9: the radiation patterns of the 4×4 heatsink antenna array.
Figure 9:
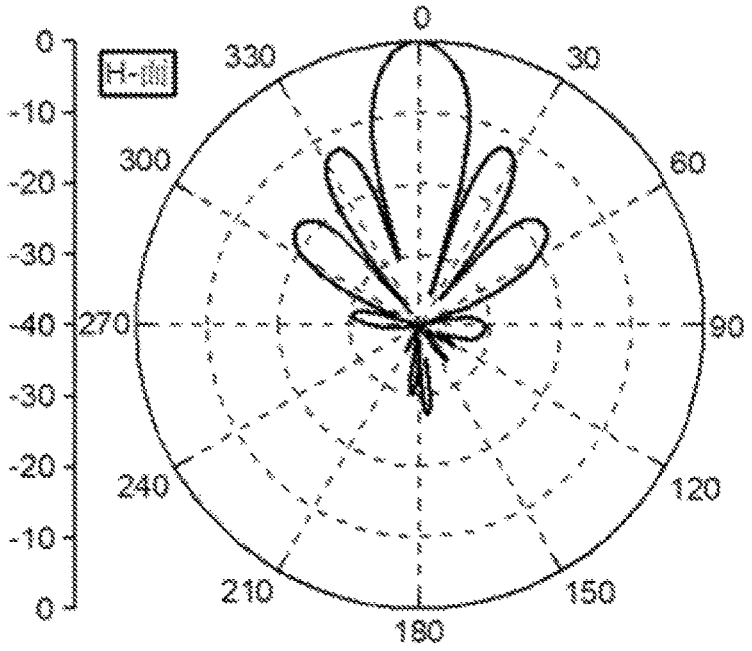

FIG. 9 shows the radiation patterns of the 4×4 heatsink antenna array. The 3-dB beamwidths in E- and H-planes are 14.8° and 15.6°, respectively.

In terms of the thermal performance, the chip should be mounted on the bottom of the low temperature co-fired ceramic substrate. The top metallic vias array 10 and the bottom metallic vias array 12 in the low temperature co-fired ceramic substrate can work as thermal vias and transfer heat from the heat source to the heatsink.

Further, according to the actual needs, the low temperature co-fired ceramic substrate can contain extra metallic vias outside the domain of substrate integrated waveguide to reduce the thermal resistance between the heat source and the heatsink.

The specific embodiments of the present invention have been described above. It should be understood that the present invention is not limited to the above specific embodiments, and those skilled in the art can make various changes or modifications within the scope of the claims, which does not affect the essence of the present invention. In the case of no conflict, the embodiments of the present invention and the features in the embodiments can be combined with each other arbitrarily.

What is claimed is:

1. A heatsink antenna array structure, comprising: a fin-shaped metal heatsink comprising a plurality of rectangularly-shaped fins; a metal bottom base of the fin-shaped metal heatsink, wherein the rectangularly-shaped fins of the fin-shaped metal heatsink are vertically connected to the metal bottom base; and a substrate, wherein the substrate includes an upper surface that is connected with the metal bottom base of the fin-shaped metal heatsink and a lower surface that is connectable with a chip, wherein the metal bottom base of the fin-shaped metal heatsink comprises a rectangular through-cavity array configured as a radiation aperture, wherein the substrate contains a multiple of metal layers and dielectric layers, wherein a top metal layer of the multiple metal layers has rectangular apertures corresponding to the rectangular through-cavity array in the metal bottom base of the fin-shaped metal heatsink, and the dielectric layers contain metallic vias to form an integrated waveguide structure, wherein the metallic vias in the dielectric layers are configured to reduce thermal resistance between the fin-shaped metal heatsink and the chip, when the heatsink antenna array structure is connected to the chip, and form the integrated waveguide structure as a feeding network of the heatsink antenna array structures;

wherein the heatsink antenna array structure is configured such that an aperture dimension of the rectangular through-cavity array is configured as a TE10 mode of rectangular waveguide, wherein each rectangular through-cavity and two adjacent metal fins form a step-profiled horn antenna with a quasi-electromagnetic operating mode.

2. The antenna array structure of claim 1, wherein the multiple of the metal layers of the substrate contains three metal layers, wherein the top metal layer, a top dielectric layer, a middle metal layer, and a top metallic vias array in the top dielectric layer form a top substrate integrated waveguide structure having a stepped transition structure, and the middle metal layer, a bottom dielectric layer, a bottom metal layer, and a bottom metallic vias array in the bottom dielectric layer form a bottom substrate integrated waveguide structure.

3. The antenna array structure of claim 2, wherein the bottom dielectric layer has an input port of the feeding network.

4. The antenna array structure of claim 2, wherein the middle metal layer has a middle metallic vias array with an anti-pad structure for transition between the top substrate integrated waveguide structure and the bottom substrate integrated waveguide structure.

5. The antenna array structure of claim 1, wherein the substrate is formed from a low temperature co-fired ceramic technique.

6. The antenna array structure of claim 1, wherein a fin height is larger than a half operating wavelength, a fin width is equal to a length of the rectangular through-cavity in the metal bottom base of the fin-shaped metal heatsink, and a spacing between the rectangularly-shaped fins is not larger than one operating wavelength.

7. The antenna array structure of claim 2, wherein the bottom substrate integrated waveguide structure forms a T-type power divider.

8. The antenna array structure of claim 1, wherein the rectangular through-cavity array is formed as a 4×4 array, wherein each through-cavity of the rectangular through-cavity array has a size of 3 mm×1.5 mm×1 mm.

9. The antenna array structure of claim 1, wherein a size of each fin of the plurality of rectangularly-shaped fins of the fin-shaped metal heatsink is 5 mm×3 mm×0.5 mm and a spacing between each fin is 4 mm.

* * * * *